US005358568A

United States Patent [19]

Okano et al.

[11] Patent Number: 5,358,568

[45] Date of Patent: Oct. 25, 1994

[54] SPRAYING APPARATUS

[75] Inventors: Tadashi Okano; Jun Nishimura; Hajime Nomura; Takehiro Yoshida, all of Tokyo; Masahiko Jotani, Saitama, all of Japan

[73] Assignees: Shimizu Corporation; Nichias Corporation, both of Tokyo, Japan

[21] Appl. No.: 18,741

[22] Filed: Feb. 17, 1993

[30] Foreign Application Priority Data

Feb. 26, 1992 [JP] Japan ..... 4-076080

[51] Int. Cl.[5] ..... B05B 13/04

[52] U.S. Cl. ..... 118/323; 118/317; 118/679; 118/712; 134/57 R; 239/73; 901/43

[58] Field of Search ..... 118/300, 305, 306, 308, 118/317, 323, 668, 669, 712, 676, 679; 134/57 R, 123, 172; 239/71, 73, 587.2, 588, 578; 901/42, 43, 47, 29

[56] References Cited

U.S. PATENT DOCUMENTS

| | | | |
|---|---|---|---|
| 1,784,251 | 12/1930 | Plumer | 239/71 X |
| 3,274,860 | 9/1966 | Gauthier et al. | 118/323 X |
| 3,606,162 | 9/1971 | Lehmann | 118/323 X |
| 4,144,837 | 3/1979 | Johnston | 118/323 X |
| 4,220,170 | 9/1980 | Hebert et al. | 134/172 X |
| 4,222,522 | 9/1980 | Kubo et al. | 901/43 X |
| 4,239,431 | 12/1980 | Davini | 118/323 X |
| 4,327,666 | 5/1982 | Lee | 118/679 |
| 4,501,223 | 2/1985 | Matsuno et al. | 118/668 |
| 4,545,156 | 10/1985 | Hockett | 118/323 X |
| 4,785,760 | 11/1988 | Tholome | 901/43 X |
| 4,878,598 | 11/1989 | Ruschhaupt, Jr. | 118/679 X |
| 4,984,745 | 1/1991 | Akeel et al. | 901/43 X |

FOREIGN PATENT DOCUMENTS

| | | |
|---|---|---|
| 0110644 | 6/1984 | European Pat. Off. . |
| 3720991 | 3/1989 | Fed. Rep. of Germany . |
| 1599117 | 10/1990 | U.S.S.R. . |
| 1004826 | 9/1965 | United Kingdom . |

*Primary Examiner*—Michael Ball
*Assistant Examiner*—Francis J. Lorin
*Attorney, Agent, or Firm*—Flynn, Thiel, Boutell & Tanis

[57] ABSTRACT

A spraying apparatus is disclosed, in which a manipulator consisting of a plurality of articulations (linear movement articulations and rotational movement articulations) is mounted on a carriage and a spraying nozzle member is mounted on the last stage rotational movement articulation, which are so constructed that material to be sprayed is supplied to this spraying nozzle member through a hose, and a piping path is formed in the interior of at least rotational movement articulations, for which it is feared that the hose becomes tangled therewith or twisted. A sensor is mounted on either the nozzle or the manipulator to detect the distance between the nozzle and the surface being sprayed. A controller responds to the signals produced by the sensor to maintain the nozzle at a substantially constant distance from the surface during spraying.

6 Claims, 4 Drawing Sheets

SPRAYING APPARATUS

FIELD OF THE INVENTION

The present invention relates to a spraying apparatus used for works of spraying a fire resistant coating material (wet or semi-dry type) on steel frames such as beams, pillars, etc. in a building, spraying ricin (dressing on a surface of underlying material of an external or internal wall of a building), or spraying a material for forming a lining layer in a chimney lining material, etc.

BACKGROUND OF THE INVENTION

In work of spraying fire resistant fiber such as rock wool together with cement slurry on steel frames such as beams, pillars, etc. in a building, since it is accompanied by recoil of sprayed material and flying apart of fire fibers harmful to a human body, work environment is extremely bad. For this reason workers are obliged to wear clothes, masks, etc. for complete defense covering their skin. Further, in spraying work, a worker holding a material supplying hose having a spraying nozzle to manipulate it must bear weight of the material and supply pressure and is forced to be engaged in heavy labor. In particular, from the point of view of safety, spraying on a beam is a work at a high ground, accompanied by danger.

Starting from the above description, recently, for the purpose of intending to improve security of spraying worker, reduction of labor, improvement of operability, etc., research and development of a spraying apparatus using a manipulator are advanced, but no apparatuses, which can sufficiently satisfy manipulability and operability, are proposed yet.

Particularly, in the case of the spraying apparatus using a manipulator, since in order to carry out spraying work, a spraying nozzle member is mounted on the extremity of the manipulator and, while material to be sprayed is carried to the nozzle member through a piping member such as a hose, a pipe, etc. with pressure, it is required that the piping member can follow smoothly movement of the manipulator without becoming tangled with the manipulator side or without being twisted, at multi-dimensional movement of the manipulator.

SUMMARY OF THE INVENTION

The object of the present invention is to provide a spraying apparatus capable of effecting spraying work in a large extent while moving a spraying nozzle arbitrarily and rapidly with a high precision with respect to a surface of a beam, a pillar, a chimney or an underlying material in a building, wherein a piping member, through which the material to be sprayed is carried with pressure, can follow smoothly movement of the manipulator side without becoming tangled with the manipulator side or without being twisted.

The spraying apparatus according to the present invention is characterized in that a manipulator including a plurality of articulations is mounted on a carriage; a spraying nozzle member is disposed on the terminal side articulation of the manipulator; and a piping path for supplying material to be sprayed to the nozzle member stated above is formed in the interior of predetermined articulations, the piping path being connected with an external piping member.

Further, in the present invention, it is preferable to dispose a sensor for detecting the distance from the nozzle member to a body, on which the material is sprayed, on the nozzle member or in the neighborhood thereof and means for controlling the distance described above by manipulating the manipulator, responding to a detection signal thus obtained.

Owing to the construction of the spraying apparatus described above, neither entanglement nor twist takes place by using the piping path disposed in the interior of articulations constituting the manipulator (a motor having a hollow shaft being used, in the case where a motor is used) for a part of the piping member for supplying material to be sprayed.

Further, owing to spraying work of the invention, the distance between the nozzle member and a sprayed body, is detected by means of the sensor and the distance stated above is controlled while manipulating the manipulator, it is possible to obtain easily a sprayed layer having a uniform thickness.

DETAILED DESCRIPTION

Figure 1:
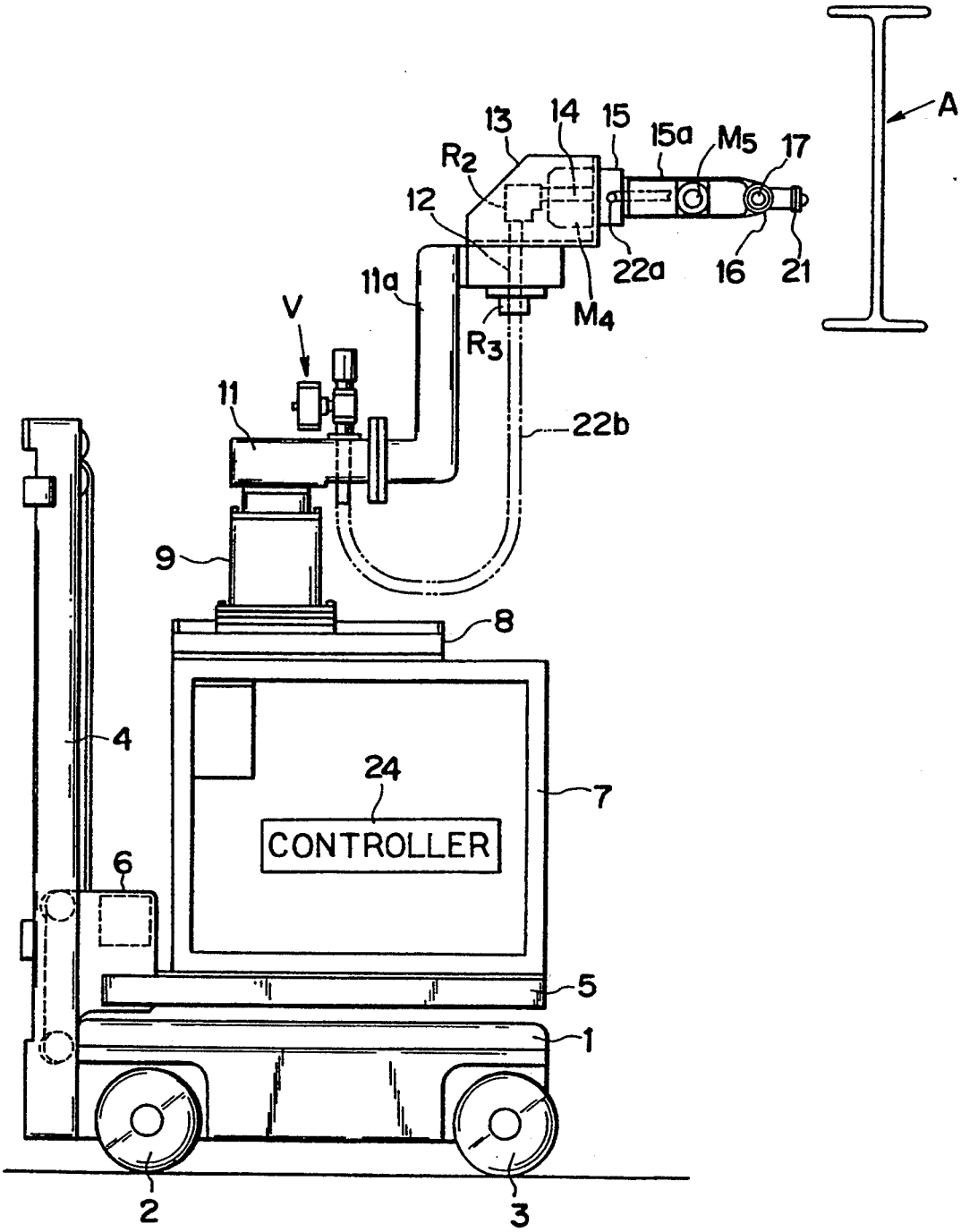
FIG. 1 is a side view of the spraying apparatus indicating an embodiment of the present invention.
Figure 2:
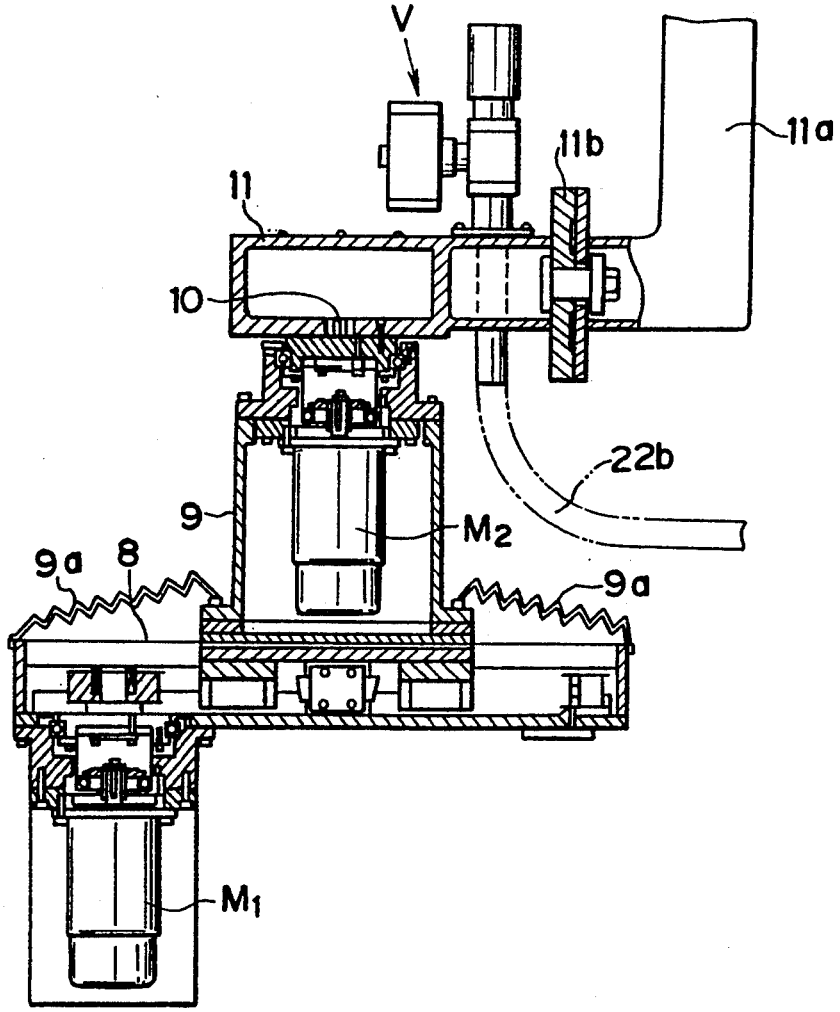
FIG. 2 is an enlarged cross-sectional view of the lower half of the apparatus indicated in FIG. 1.
Figure 3:
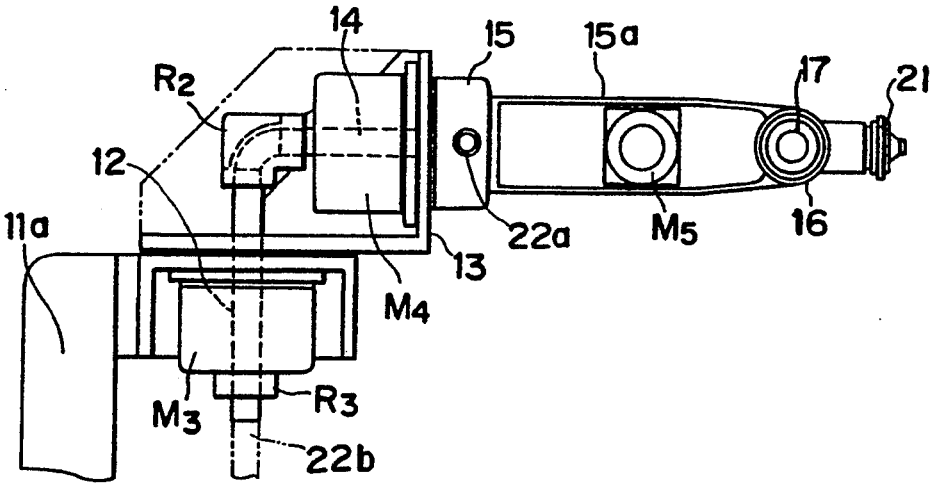
FIG. 3 is an enlarged cross-sectional view of the upper half of the apparatus indicated in FIG. 1.
Figure 4:
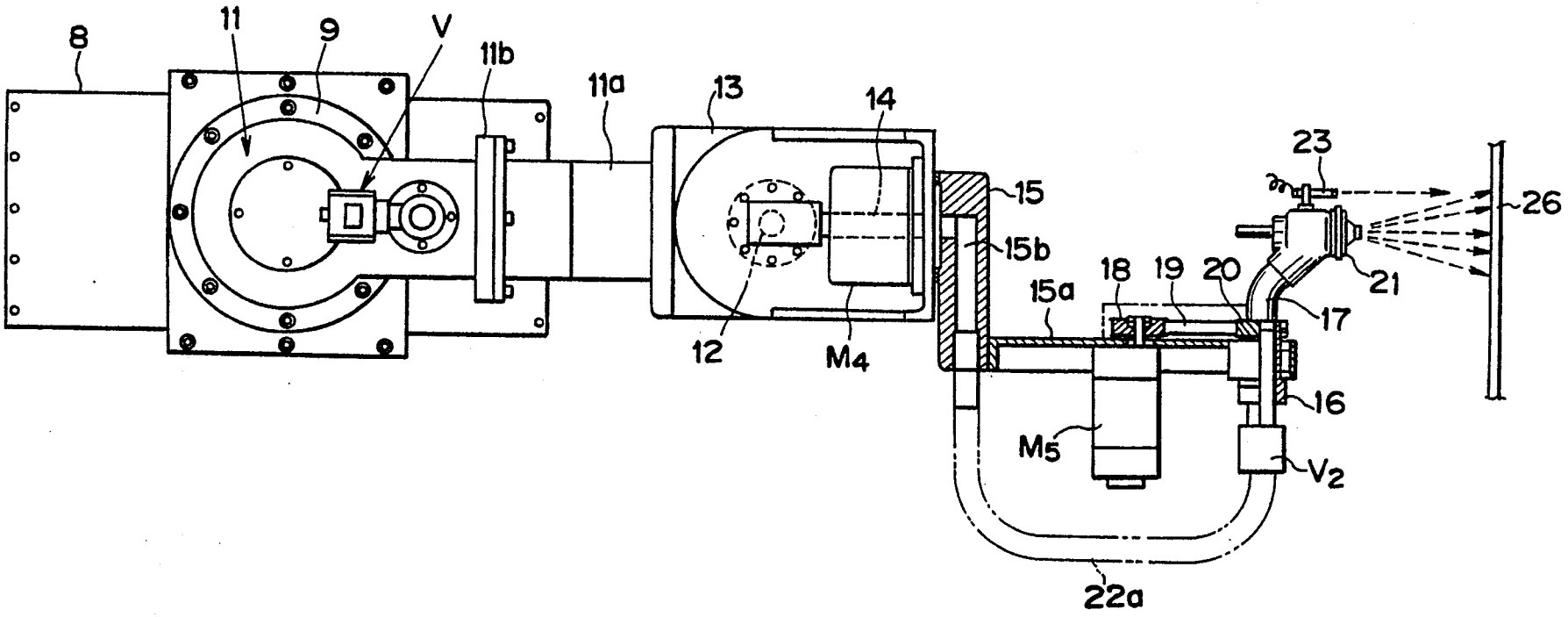
FIG. 4 is a plan view of the principal part of the apparatus indicated in FIG. 1.

FIGS. 1 to 4 show an embodiment of the present invention.

In these figures, reference numeral 1 is a moving carriage capable of moving obliquely, provided with a hydraulic motor (not indicated in the figures) driving wheels; 2 is a front wheel; and 3 is a rear wheel.

A guiding pole 4 stands at one end of the moving carriage 1 and a rising and lowering platform 5 acting as a first moving body (articulating portion for a linear movement) is mounted thereon movably in the up and downward direction (Z-direction) by a suitable driving mechanism through a holding member 6.

A machine box 7 containing controlling devices 24, etc. is secured to the platform 5. A rail plate 8 is fixed thereto in a horizontal direction and a cylindrical frame body 9 acting as a second moving body (articulating portion for a linear movement) is disposed thereon movably in the Y direction. The movement of the frame body 9 is controlled by a transmitting mechanism, whose driving source is a servo-motor M1 disposed on the rail plate 8 side. *9a* represents a bellow cover.

On the frame body 9, an arm frame 11 having a pivoting shaft 10 perpendicular to the moving direction thereof is supported, which acts as a third moving body (articulating portion for a rotational movement). The pivoting movement of the arm frame 11 is controlled by a transmitting mechanism, whose driving source is a servo-motor M2 disposed within the frame body 9.

At the upper end of the extremity portion *11a* of the arm frame 11 a box-shaped frame body 13 having a hollow pivoting shaft 12 parallel to the pivoting axe thereof is supported, which acts as a fourth moving body (articulating portion for a rotational movement).

The pivoting movement of the frame body 13 is controlled by a transmitting mechanism, whose driving source is a servo-motor M3 disposed within the extremity portion of the arm frame 11. 11*b* is a folding joint.

An arm frame 15 having a hollow pivoting shaft 14 perpendicular to the pivoting shaft 12 described above is supported by the box-shaped frame body 13, which arm frame 15 acts as a fifth moving body (articulating portion for a rotational movement). The pivoting movement of the arm frame 15 is controlled by a transmitting mechanism, whose driving source is a servo-motor M4 disposed within the frame body 13.

A piping member 17 having a pivoting shaft 16 perpendicular to the hollow pivoting shaft 14 of the arm frame 15 is supported by the extremity portion 15*a* thereof, which piping member 17 acts as a sixth moving body (articulating portion for a rotational movement). The pivoting movement of the piping member 17 is controlled by a transmitting mechanism, whose driving source is an induction motor M5 disposed in the extremity portion 15*a*. In the example indicated in the figures this transmitting mechanism comprises a pulley 18, a belt 19 and a pulley 20.

A nozzle member 21 having an ejection opening in a direction of the pivoting axis of the piping member 17 is supported at the extremity thereof so that it is connected with the piping member 17.

An end of a material supplying hose 22*a* is connected with the proximal mouth of the piping member 17 described above through a rotary joint R1, while the other end of the hose 22*b* is connected with the opening portion of the piping path 15*b* formed within the arm frame at the side surface of the pivoting arm frame 15 described above. The piping path 15*b* stated above is a pivoting shaft and connected with a hollow pivoting shaft 14 having the rotating shaft of the controlling servo-motor M4 of the fifth moving body as the material supplying piping path. This hollow pivoting shaft 14 is connected with the hollow pivoting shaft 12 of the motor M3 through a rotary joint R2. One end of the material supplying hose 22*b* is connected with the lower end of the hollow pivoting shaft 12 acting as the piping path through a rotary joint R3, while the other end of the hose 22*b* is connected with the outlet side of an electromagnetic valve V supported by the arm frame 11 described previously. A supplying hose (not indicated in the figure) led from a reservoir for preparing the material to be sprayed through a pump is connected with the inlet side of the electromagnetic valve V.

A sensor 23 is disposed on the nozzle member 21, which sensor 23 emits ultrasound, infrared ray, etc. in a direction approximately parallel to the ejection of the material to be sprayed to detect the distance between the nozzle member and the body, on which the material is sprayed. A detection signal from the sensor 23 is given to a controller 24 disposed in the machine box 7 and the controller controls the various motors described previously on the basis of this signal so as to set the spraying position of the nozzle member 21.

The various moving bodies constituting the spraying apparatus described above can be manipulated automatically manually by remote control from a control panel controlling the driving motors therefor, but since the devices such as controlling circuits, etc. don't belong to the principal part of the present invention, explanation thereof is omitted.

Figure 5:
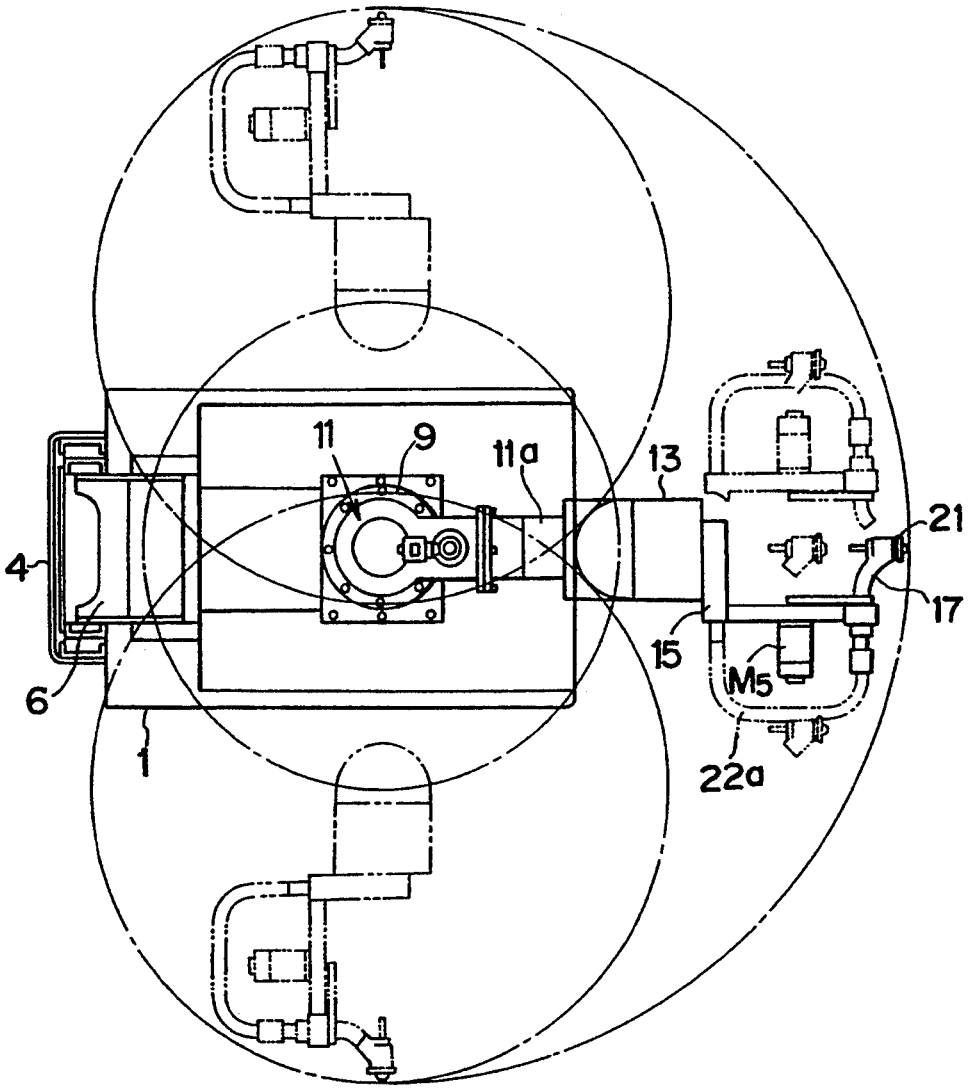
FIG. 5 is a diagram for explaining the operation of the apparatus indicated in FIG. 1.

In the case where work for spraying a fire resistant material to a steel frame A in a building is carried out by using the spraying apparatus constructed as described above. The operation of the various moving bodies, will be explained, referring to FIG. 5.

(1) Pivoting movement of the pivoting shaft 16

Performs swinging movement of the nozzle member 21 so as to direct the nozzle member to an upper, side or lower part of a wall surface.

(2) Pivoting movement of the pivoting shaft 14

Performs pivoting movement in a vertical direction of the piping member 17 for the nozzle. The pivoting movement is effected also for avoiding an obstacle to the hose, etc., in the case where spraying is effected to a part at an end of the building. The pivoting shaft 16 stated above can swing horizontally by pivoting this shaft by 90°.

(3) Pivoting movement of the pivoting shaft 12

Performs horizontal pivoting movement of the piping member 17 for the nozzle to the right and the left. This shaft complements the pivoting shaft 10 described later. Further spraying is effected while moving the nozzle member parallelly to the wall surface owing to complementing movements of the pivoting shaft 10 described later and the moving body in the Y-direction.

The whole size of the apparatus can be reduced by folding it at the joint 11*b*.

(4) Pivoting movement of the pivoting shaft 10

Performs horizontal pivoting movement of the piping member 17 for the nozzle. This shaft defines a fundamental axis for the spray and moves the whole driving system by the pivoting shaft 16 and the pivoting shaft 14.

(5) Movement of the frame body 9 in the Y direction

Moves the whole driving system by the pivoting shafts 16, 14, 12 and 10.

Spraying work is carried out while controlling the spraying nozzle member at a position optimum for the spraying work by moving the various moving bodies (articulations) described above. Owing to such construction, that the material supplying piping path is formed in the interior of the moving bodies (including pivoting shafts), with which the hose becomes tangled easily, and the material supplying path is composed of an external supplying hose together therewith, there is no fear that the hose becomes tangled with the moving bodies or twisted.

The material supplying piping path may be formed not only in the moving bodies, with which the hose becomes tangled easily, but in all the moving bodies.

In addition, owing to the construction, in which there is disposed the sensor 23 for measuring the distance to the body, on which the material should be sprayed, in the nozzle member 21, it is possible to control the nozzle member at a suitable position by manipulating necessary moving bodies on the basis of the detection signal from this sensor. Further the apparatus has a complementing moving function, to set all the third, the fourth and the sixth moving body in the Y-direction and to move the nozzle member with a constant speed in the X-direction. In this way it is possible to carry out the spraying work while maintaining the nozzle member at a constant distance from the surface, on which the material should be sprayed. Owing to these two functions it is possible to make the spray thickness uniform and to improve remarkably the efficiency of the spraying work.

Figure 6:
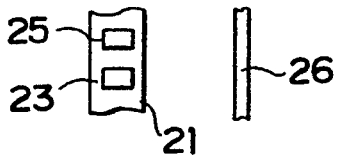
FIG. 6 is a schematical diagram indicating a modified example of the apparatus indicated in FIG. 1.

In addition, if there is disposed, apart from the sensor 23, a projector 25 irradiating approximately the central portion of a spray region on the surface, on which the material should be sprayed by means of the nozzle member 21, with a spot light (e.g. red light) in the nozzle member 21, as indicated in FIG. 6, since it is possible to confirm the part, on which the material should be sprayed, with the eye by using the spot light projected on the body, on which the material should be sprayed, it is possible to set the nozzle member at a position most preferable for spraying the material. This has an remarkable effect, particularly when spraying is effected at an edge portion or a corner portion of a steel frame, etc. and is efficient also for spray for repairing regions, for which the thickness is insufficient.

As described above, according to the present invention, since a part of the material supplying hose to the spraying nozzle member disposed at the extremity side of the manipulator consisting of a plurality of articulations is constructed by the piping path formed in the interior of the articulations, with which the hose becomes tangled easily, it is possible to obtain a spraying apparatus without any fear that the material supplying hose becomes tangled with the articulations or twisted.

Further by the spraying work according to the present invention, since the distance between the spraying nozzle member and the sprayed body, is detected by the sensor and the position of the nozzle member can be controlled by manipulating the manipulator on the basis of the detection signal thus obtained, it is possible to make the spray thickness uniform and to improve remarkably the efficiency of the spraying work.

What is claimed is:

1. A spraying apparatus comprising:

a carriage movable in a Y-axis direction;

a rising and lowering platform supported on said carriage for movement relative thereto in a Z-axis direction;

a manipulator which has a plurality of articulations and is supported on said platform;

a spraying nozzle member disposed on a terminal side articulation of said manipulator;

means for supplying material to be sprayed to said nozzle member, including a first piping member disposed in an interior of one of said articulations, and an external second piping member communicating with said first piping member;

a sensor for detecting a distance between said nozzle member and a body on which the material should be sprayed, said sensor being supported on one of said nozzle member and said manipulator; and control means for controlling a position of said nozzle member in response to a detection signal from said sensor so that said manipulator is positioned in the Y-axis direction and said nozzle is moved in an X-axis direction to carry out spraying while maintaining the nozzle member at a substantially constant distance from a surface of said body.

2. A spraying apparatus according to claim 1, further including a projector for emitting spot light which irradiates approximately a central portion of a spray region on said surface to facilitate positioning of the nozzle member at a position most preferable for spraying the material on said surface, said projector being supported on one of said nozzle member and said manipulator.

3. A spraying apparatus according to claim 1, wherein said manipulator includes a plurality of motors which each effect linear or rotational movement of a respective said articulation thereof, and which are controlled by said control means.

4. A spraying apparatus, comprising: a carriage supported for movement in a first direction; a platform supported on said carriage for movement relative thereto in a second direction approximately perpendicular to said first direction; a spraying nozzle member; manipulator means having a first end supported on said platform and having said nozzle member supported at a second end thereof; said manipulator means including a plurality of manipulator elements and including a plurality of articulation joints which each movably couple a respective adjacent pair of said manipulator elements, one of said articulation joints including a first piping member and supporting one of said manipulation elements for pivotal movement about said first piping member relative to another thereof; means for supplying a material to be sprayed to said nozzle member, including an opening through said first piping member and including a second piping member having therethrough an opening which is in communication with said opening through said first piping member; sensor means supported on one of said nozzle member and said manipulator means for detecting a distance between said nozzle member and a surface to be sprayed; and control means responsive to said sensor means during a spraying operation for controlling movement of said platform relative to said carriage and movement of said manipulator means so as to maintain said nozzle member at a substantially constant distance from the surface to be sprayed.

5. A spraying apparatus according to claim 4, wherein said second piping member is flexible.

6. A spraying apparatus according to claim 5, wherein another of said articulation joints includes a third piping member and supports one of said manipulation elements for pivotal movement about said third piping member relative to another of said manipulation elements, said means for supplying including an opening through said third piping member and including said opening through said second piping member being in communication with said opening through said third piping member.

* * * * *